US005979697A

United States Patent [19]

Kim

[11] Patent Number: 5,979,697

[45] Date of Patent: Nov. 9, 1999

[54] LID WITH CLOSABLE SPOUT

[76] Inventor: Jonathan Kim, 35-14 146th St., Flushing, N.Y. 11354

[21] Appl. No.: 09/030,679

[22] Filed: Feb. 26, 1998

[51] Int. Cl.[6] ..... A47G 19/22

[52] U.S. Cl. ..... 220/713; 220/717

[58] Field of Search ..... 220/711, 713, 220/717

[56] References Cited

U.S. PATENT DOCUMENTS

| | | | |
|---|---|---|---|
| 4,239,123 | 12/1980 | Lang et al. . | |
| 4,243,156 | 1/1981 | Cobbestael . | |
| 4,407,425 | 10/1983 | Combs . | |
| 4,428,498 | 1/1984 | Obey | 220/367 |
| 4,561,557 | 12/1985 | Park . | |
| 4,579,257 | 4/1986 | Brändlein . | |
| 4,589,578 | 5/1986 | Hayward | 222/529 |
| 4,756,440 | 7/1988 | Gartner . | |
| 4,782,975 | 11/1988 | Coy . | |
| 5,392,589 | 2/1995 | Buchanan | 53/412 |
| 5,538,157 | 7/1996 | Proshan . | |
| 5,816,428 | 10/1998 | Plester | 220/257 |
| 5,823,404 | 10/1998 | Ronchail | 220/270 X |

*Primary Examiner*—Stephen K. Cronin
*Attorney, Agent, or Firm*—Friscia & Nussbaum

[57] ABSTRACT

The lid with re-closable spout invention can be used with a hot and/or cold beverage container or other fluid container. The lid fits onto the container as is known in the art. The lid includes a spout formed on the lid and extending from the lid which allows one to access the contents of the fluid container. The spout can be positioned in a closed position wherein it is folded in to prevent the contents of the fluid container from exiting the spout. The spout may be locked into a closed position. In a second, open position, the spout is folded out to allow the fluid within the fluid container to be poured out of the fluid container through the spout. After use and/or between uses, the spout can be re-closed and re-sealed. The spout can be any desired configuration including generally square or rectangular, or generally cylindrical. The sealing means can be a zipper-type engagement formed on the upper edge of the spout.

17 Claims, 3 Drawing Sheets

LID WITH CLOSABLE SPOUT

BACKGROUND OF THE INVENTION

1. Field of the Invention

This invention relates generally to a spill-proof spout for a lid of a container, and more specifically to a spout for a liquid container that can be opened for use and then closed and sealed after use or between uses.

2. Related Art

Disposable and re-usable containers for beverages and/or other fluids are in wide use. Numerous attempts have been made in the past to provide lids with mechanisms to prevent the spilling of the fluid within the container during use. For example, with beverage containers, it has been known to form small openings in the lid to decrease the likelihood of spillage. Additionally, lids with frangible portions have been made, the frangible portions being broken prior to use. Such lids, however are difficult, if not impossible, to re-seal and do not adequately function to prevent spillage.

Commonly, beverages are purchased in disposable containers and then taken along by a person either in a car or in some other type of transportation, or the container is carried and the contents consumed while one travels to a location. However, it is widely known that there is a risk associated in that the beverage can spill onto the user, or within the vehicle, if the beverage container is tilted to far or dropped.

Accordingly, what is desirable and has not heretofore been developed, is a lid which can be closed between uses and/or after use, and which can be sealed when closed, and which can be easily opened to allow one to drink or otherwise utilize the fluid within the container with a reduced risk of spilling the fluid.

Some of the numerous efforts to provide a lid that prevent the spilling of fluid are as follows:

Proshan, U.S. Pat. No. 5,538,157, discloses a lid having a rectangularly shaped spout with upper and lower ends interconnected with the lid. The user can drink from a container by use of the spout.

Coy, U.S. Pat. No. 4,782,975, discloses a lid which includes a spout with a flow control valve housed within the spout. The valve and spout are formed of a resilient material. The valve is normally closed, but is openable by pressure applied external to the spout by one's lips. The lid may be formed of any desired material such as plastic or paper or cardboard. A tab is initially applied over the spout. The spout includes a valve formed of a flexible and resilient material such as rubber.

Gartner, U.S. Pat. No. 4,756,440, discloses an anti-spill lid having a drinking spout formed on the lid. The spout includes a plurality of apertures on the upper tip thereof to allow one to suck liquid out from the container. No vent is supplied on the lid so that one must apply suction in order to remove liquid from the container, the suction pulling the flexible lid downward during use. After the spout is released, air enters into the container via the apertures in the spout.

Brändlein, U.S. Pat. No. 4,579,257, discloses a lid for a can, the lid including a pouring spout. The spout can serve to pour contents or can be used directly as a drinking opening. A cap may be provided for the spout.

Park, et al., U.S. Pat. No. 4,561,557, discloses a beverage container including a spout. The spout is positioned to extend below the lid and is opened upon pulling a tab to pivot the spout to extend up from the lid.

Combs, U.S. Pat. No. 4,407,425, discloses a lid for a beverage container including a flexible spout member with a base portion secured to the lid. A closure strip is applied over the spout and the spout is folded down in a closed position and when opened, by removing the closure strip, the spout pivots upwardly to an open position.

Lobbestael, U.S. Pat. No. 4,243,156, discloses a lid having a tubular spout and having a cap formed on the spout for closing the spout. The cap can be detached from the spout to utilize the spout for drinking.

Lang, et al., U.S. Pat. No. 4,239,123, discloses a mouthpiece for use on a container having a tear-open closure slot. The mouthpiece is insertable into the opening in the container to form a liquid tight seal therewith.

None of these efforts, taken either alone or in combination, teach or suggest all of the benefits and the utility of the present invention.

OBJECTS AND SUMMARY OF THE INVENTION

It is a primary object of the present invention to provide a spout for a lid of a beverage container to minimize spillage of a beverage within the container.

It is another object of the present invention to provide a spout a lid of a beverage container which enables one to easily consume the beverage.

It is an additional object of the present invention to provide a spout for a lid of a fluid container that allows for the fluid to be easily poured therefrom.

It is even an additional object of the present invention to provide a spout for a lid of a fluid container, which spout is re-closable.

It is still even an additional object of the present invention to provide a spout for a lid of a fluid container, which spout can be re-closed between uses or after a use.

It is still a further object of the present invention to provide a spout for a lid for a fluid container, which spout can be sealed in a closed position.

It is even a further object of the present invention to provide a spout for a lid for a fluid container, which spout can be opened and closed as desired, and can be sealed or locked into a closed position.

It is yet another object of the present invention to provide a spout for a lid of a fluid container whereby the fluid container can be discarded after use and the lid and spout can be re-used on another fluid container.

It is even another object of the present invention to provide a spout for a lid of a fluid container, which spout is large enough to obviate the need for a separate air hole in the lid.

It is still a further object of the present invention to provide a lid having a re-closable spout which is simple and easy to manufacture.

It is even another object of the present invention to provide a lid with a re-closable spout which is relatively inexpensive to manufacture.

The re-closable spout of the present invention can be used with a hot and/or cold beverage container or other fluid container. The lid fits onto the container as is known in the art. The lid includes a spout formed on the lid and extending from the lid to allow one to access the contents of the fluid container. The spout can be positioned in a closed position wherein it is folded back to prevent the contents of the fluid container from exiting the spout. The spout may be locked or sealed into a closed position. In a second, open position, the spout is unsealed and by folding the spout out to allow the fluid within the fluid container to be poured out of the fluid container through the spout. After use and/or between uses, the spout can be re-closed and re-sealed. The spout can be of any desired configuration such as generally square shaped, generally rectangular, or generally cylindrical. The sealing means can be a zipper-type engagement formed on the upper edges of the spout.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Referring to FIGS. 1–5, the combination of the spout, lid and fluid container of the present invention is generally indicated at 10. The fluid container 12 can be a coffee cup, soda cup, or any other type of beverage container. Further, the fluid container 12 could be a oil can or container, or a container for any other type of fluid. The lid 14 for the fluid container 12 can be any type of lid for attachment to a fluid container 12. For example, the lid 14 could be a lid for a coffee cup, or for a soda cup, or for an oil container, or for any other type of container wherein a lid is applied or could be applied to close a fluid container.

The spout, generally indicated at 20, is interconnected with the lid 14 as is known in the art. The spout 20 could be formed integrally with the lid 14, or the lid 14 and the spout 20 could be formed separately in the manufacturing process and then attached together. As shown in FIGS. 1–5, the spout can be generally rectangular in appearance and includes base edges 22, 24, 26, and 28 defining a generally rectangular base. These base edges 22, 24, 26 and 28 define edges formed on the lid 14 creating an aperture in the lid 14 where at the spout is positioned and through which fluid can travel from the fluid container 12, through the spout 20. As will be hereinafter described, the spout 20 can be configured to have any desirable shape.

Figure 4:
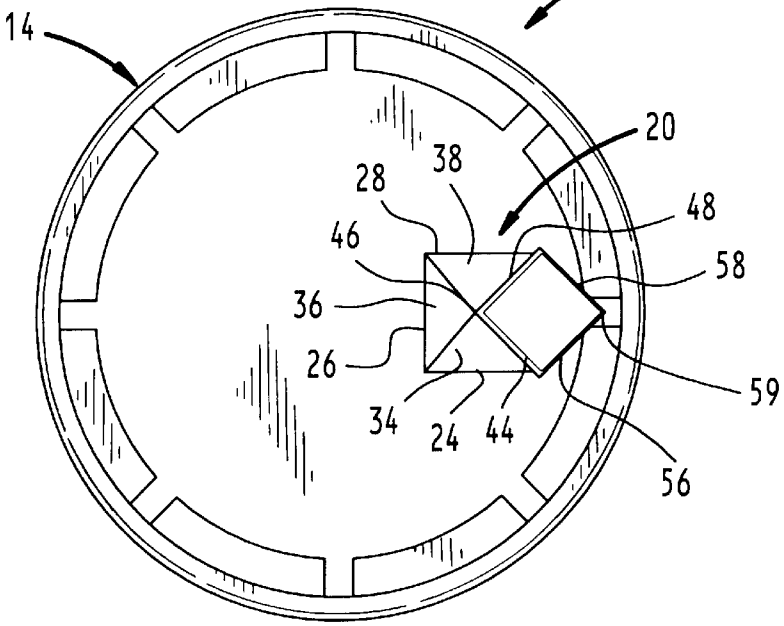
FIG. 4 is a top plan view of the spout shown in FIG. 1.

The spout 20 also includes wall members 32, 34, 36, and 38 extending up from the base edges 22, 24, 26, and 28, respectively, to define the spout. As shown in FIG. 4, rear wall member 36, extending from base edge 26, is folded or triangularly configured to extend from the full width of base edge 26 up to a gathering point 46 wherein the side wall members 34 and 38, and the rear wall member 36 meet. Side wall members 34 and 38 are generally rectangular and extend from base edges 24 and 28 up to upper edges 44 and 48, respectively. Side wall members 34 and 38 are joined together at gathering point 46. Additionally, the upper edges 44 and 48 can be joined together or spread apart as will hereinafter be described.

The forward wall member 32 is preferably formed from an expanded amount of material which can be folded out from the rear and side wall members 34, 36, and 38 to open the spout, or which can be folded in to close the spout. Accordingly, forward wall member 32 includes forward center member 50 and forward side members 52 and 54 defined by folds indicated at 53 and 55. Upper edges 56 and 58 of the forward side members 52 and 54, and the peak of forward center member 50, join to form the point 59 of the spout 20.

The spout 20 is opened and closed folding the forward wall member 32 in and out with respect to the side wall members 34 and 38. The spout 20 can be positioned in an opened position by spreading upper edges 44 and 48 of the side wall members 34 and 38 to allow the point 59 of the spout 20 and the forward wall member 32 to be pulled out and away from the upper edges 44 and 48 to position the spout in an open position. In this position, forward center member 50 and forward side members 52 and 54 are positioned to extend away from the side wall members 34 and 38. Thereafter, the spout can be closed by pushing the point 59 of spout 20 forward towards the rear wall member 36 and between upper edges 44 and 48 and side wall members 34 and 38, to fold forward wall member 32 back within the spout 20. In this position, forward center member 50 and forward side members 52 and 54 are positioned between side wall members 34 and 38.

Figure 1:
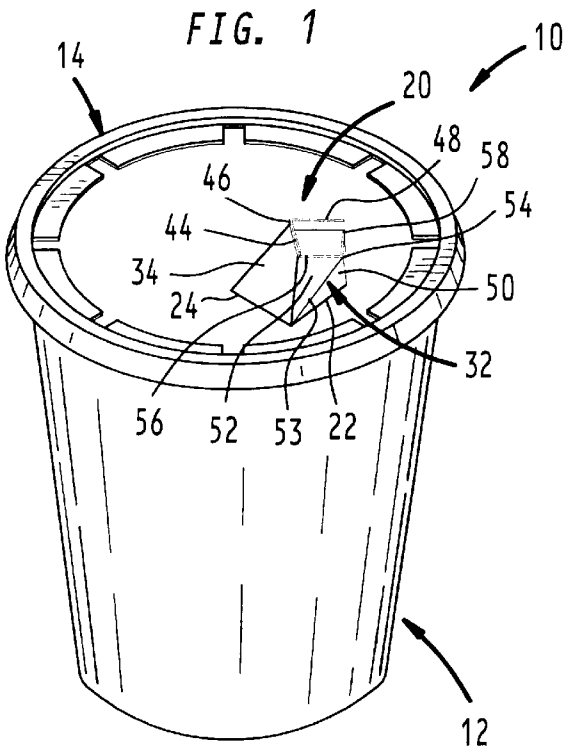
FIG. 1 is a perspective view of the spout of the present invention interconnected with a lid attached to a beverage container wherein the spout is in an open position.
Figure 2:
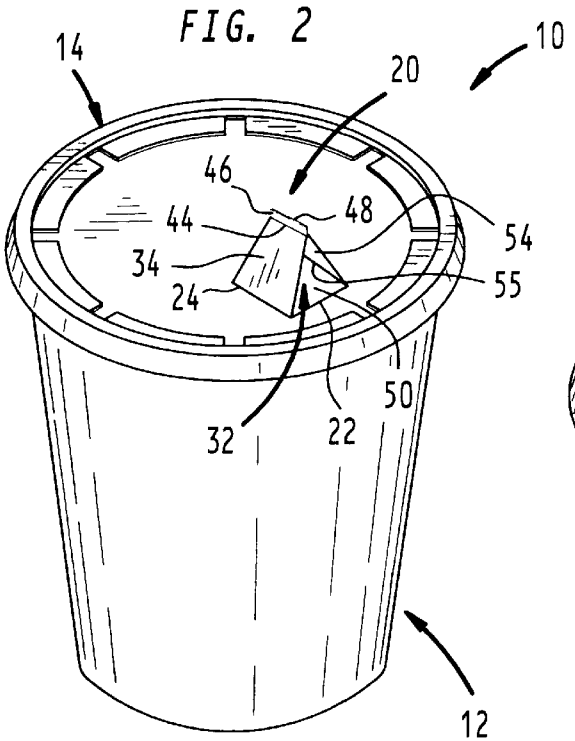
FIG. 2 is a perspective view of the spout shown in FIG. 1, is in a closed position.
Figure 3:
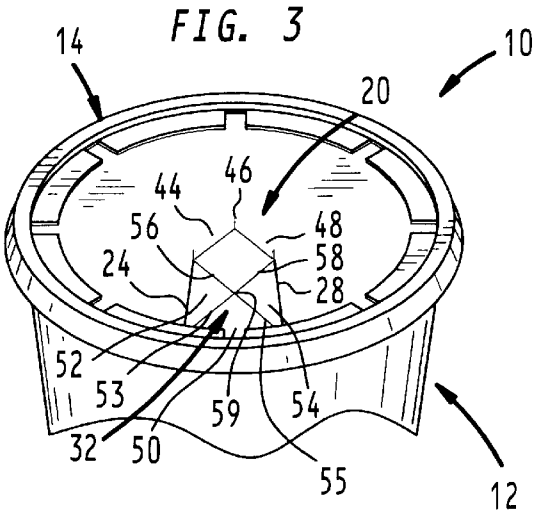
FIG. 3 is a perspective view of the spout shown in FIG. 1 from a forward angle.
Figure 5:
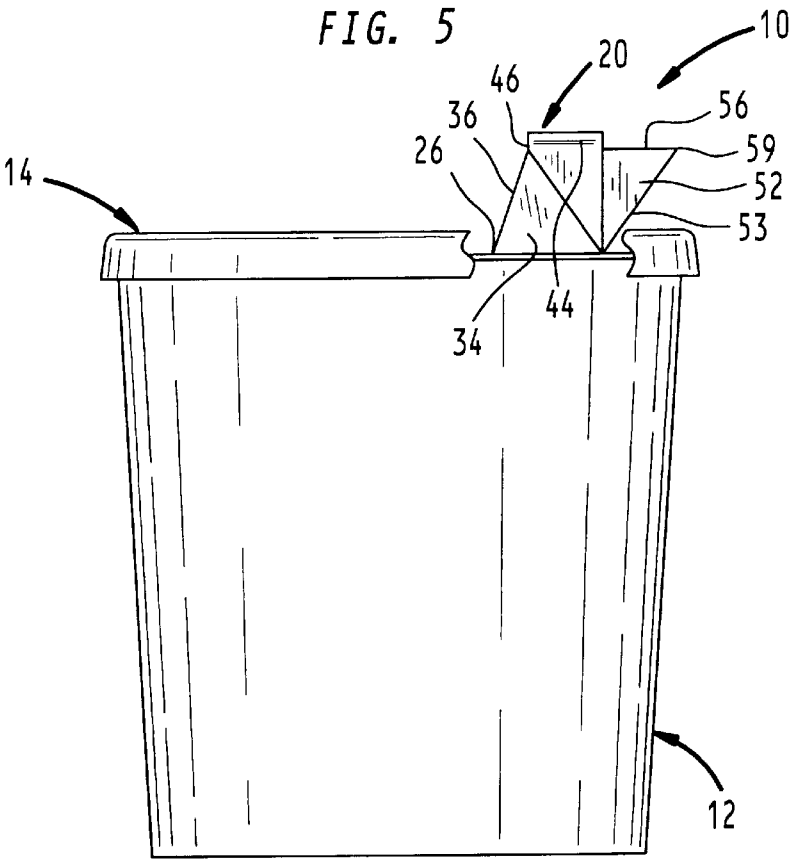
FIG. 5 is a side plan view of the spout shown in FIG. 1.

Sealing means may be provided such as, for example, by a zipper-type means wherein the upper edges 44 and 48 of the side wall members 34 and 38 include male and female mating portions on inner sides thereof, respectively, extending along the lengths thereof such that when the forward point 59 of the spout 20 is folded to extend between the side wall members 34 and 38, the male and female attachment means on the interiors of the upper edges 44 and 48 coact to engage and seal the spout 20 in a closed position. Referring to FIGS. 3 and 5, it can be seen that the upper edges 44 and 48 are positioned to extend above the upper edges 56 and 58 of the spout 20 to allow the spout 20 to be folded back within the side wall members 34 and 38, and then allow the male and female engagement means associated with the upper edges 44 and 48, respectively, to coact to seal the spout 20 closed. Other sealing means known in the art, including adhesive means may be used to seal the spout 20 in a closed position. Alternatively, the inherent resilience of the material from which the spout 20 is fabricated can be used to retain the spout 20 in a closed position, and/or the spout 20 could merely be biased in a closed position.

It should also be pointed out that in order to open the spout 20, one merely spreads the upper edges 44 and 48 to disengage the engagement or sealing means, or to overcome the bias, and then the point 59 and forward wall 32 including the forward center member 50 and the forward side members 52 and 54 spring out or are pulled out to open the spout 20.

Figure 8:
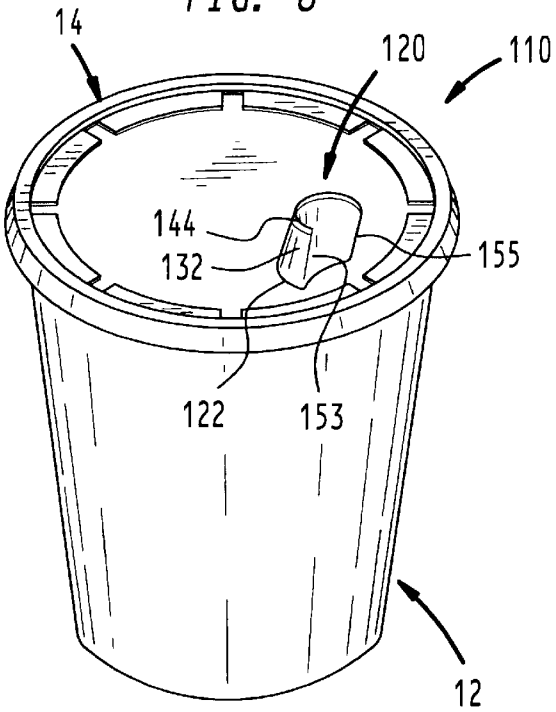
FIG. 8 is a perspective view of the spout of FIG. 6 in a closed position.
Figure 7:
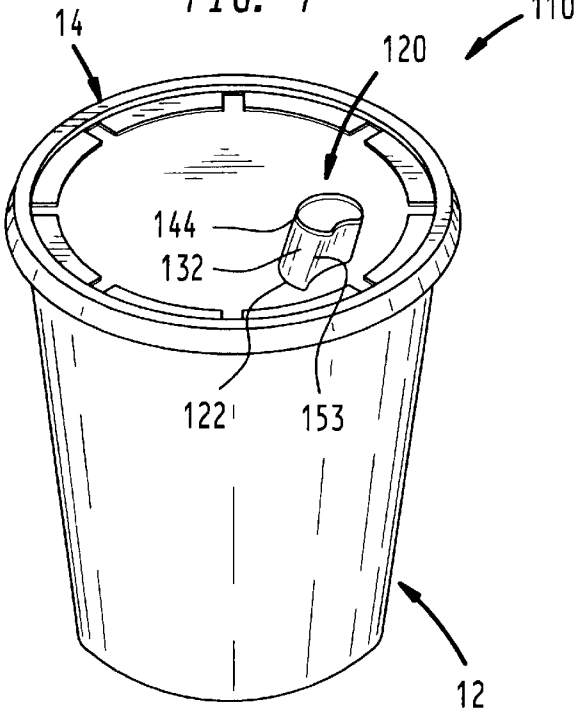
FIG. 7 is a perspective view of the spout of FIG. 6 in a partially closed position.
Figure 6:
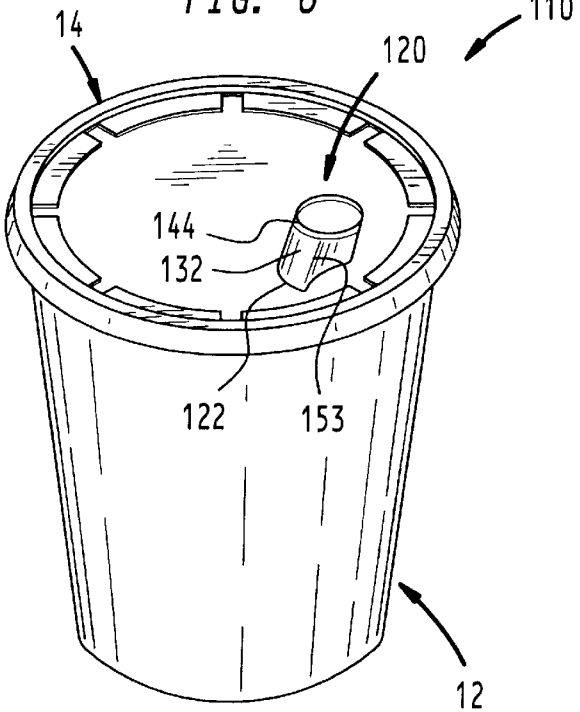
FIG. 6 is a perspective view of another embodiment of the spout of the present invention having a semi-cylindrical shape.

Referring now to FIGS. 6–8, another embodiment of the present invention is shown wherein the fluid container is still generally indicated at 12, the lid is still generally indicated at 14, and the combination of the spout, lid, and fluid container is generally indicated at 110. The spout, generally indicated at 120, is semi-cylindrical in shape. It should be noted that the spout 120 can be of any shape from cylindrical to semi-cylindrical as desired. Accordingly the base edge of the spout 120, generally indicated at 122, is interconnected with the lid 14 in any manner known in the art such as by being formed in the same process, or by being formed separately and then attached together. The upstanding wall 132 defining the spout 120 is continuous about the spout. Creases 153 and 155 are formed as the upper edge 144 of the spout 120 are pushed together to close the spout 120. The interior of the upper edge of the lid 144 may include male and female engagement means, or any other type of engagement means known in the art, for allowing the spout 120 to be sealed. In order to seal the spout 120, the upper edge 144 is pressed together to close off the spout 120. In order to open the spout 120, the upper edge is merely separated to open the spout 120 and allow for fluid in the fluid container 12 to be poured through the spout 120 as desired.

Having thus described the invention in detail, it is to be understood that the foregoing description is not intended to limit the spirit and scope thereof. What is desired to be protected by Letters Patent is set forth in the appended claims.

What is claimed is:

1. A flexible spout for a lid for a fluid container comprising:

base means for interconnecting the spout with a lid;

upstanding wall means interconnected with the base means for defining a spout;

upper lip means on the upstanding wall means for defining the upper end of the spout through which fluid can be poured;

sealing means formed on the upper lip means for sealing engagement of opposite upper ends of the spout; and means for opening and closing the spout.

2. The apparatus of claim 1 wherein the upstanding wall means is continuous.

3. The apparatus of claim 1 wherein the upstanding wall means comprises a plurality of wall members including a rear wall member, side wall members and a forward wall member.

4. The apparatus of claim 3 wherein the rear and side wall members extend to a common upper point.

5. The apparatus of claim 4 wherein the rear wall member is triangular and meets the side walls at an upper point.

6. The apparatus of claim 3 wherein the means for sealing comprises male and female engagement means interconnected on interior upper edges of the side wall members.

7. The apparatus of claim 6 wherein the forward wall member comprises a forward center member and forward side members, the forward wall member foldable to be positioned interiorly of the side walls to close the spout, and to be extended out to open the spout.

8. The apparatus of claim 7 wherein upper edges of the side wall members extend beyond upper edges of the forward side members, and the engagement means are positioned on the upper edges of the side wall members.

9. The apparatus of claim 8 wherein the engagement means comprises male and female engagement means.

10. A lid for a fluid container comprising:

circumferential attachment means for attachment to a fluid container;

base means extending between the circumferential attachment means;

rectangular edges interconnected with the base means, the rectangular edges including forward, side and rear edges;

forward, side and rear walls extending from the edges;

the side walls being generally rectangular and positioned proximately at their upper edges;

the rear wall being generally triangular and sized to extend from the rear edge to the proximate upper edges of the side walls;

the upper edges of the side walls and the rear wall being joined together to form a point of attachment;

the forward wall extending from the forward edge and including a front center member and two forward side members; and a point formed by the forward center member and the forward side members.

11. The apparatus of claim 10 wherein the side walls extend past the forward wall.

12. The apparatus of claim 11 wherein the forward wall is folded to extend between the side walls.

13. The apparatus of claim 12 wherein upper interior edges of the side walls include attachment means.

14. The apparatus of claim 13 wherein the attachment means are engaged when the forward wall is folded to a position between the side walls to seal the spout.

15. A method for sealing opening and re-sealing a fluid container comprising the steps of:

providing a lid for attachment to a fluid container;

interconnecting one or more upstanding walls with the lid to form a spout;

providing engagement means on opposing upper edges of the spout;

engaging the engagement means to attach the opposing upper edges of the spout together to seal the spout;

disengaging the engagement means to open the spout and separating the opposing upper edges of the spout to open the spout; and re-sealing the spout by pressing together the opposing upper edges of the spout to re-engage the engagement means.

16. The method of claim 15 wherein the step of opening the spout comprises the step of pulling a front wall of the spout away from a rear wall of the spout to fold out the front wall of the spout to open the spout.

17. The method of claim 15 wherein the step of engaging the engagement means comprises the step of interconnecting male and female engagement means on opposing upper edges of the spout.

* * * * *